US008798872B2

(12) United States Patent
Kagoshima et al.

(10) Patent No.: US 8,798,872 B2
(45) Date of Patent: Aug. 5, 2014

(54) ROTATION CONTROL DEVICE FOR WORKING MACHINE

(75) Inventors: Masayuki Kagoshima, Hiroshima (JP); Masayuki Komiyama, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 1375 days.

(21) Appl. No.: 11/861,811

(22) Filed: Sep. 26, 2007

(65) Prior Publication Data

US 2008/0082240 A1 Apr. 3, 2008

(30) Foreign Application Priority Data

Sep. 29, 2006 (JP) ..... 2006-268499

(51) Int. Cl.
*G06F 19/00* (2011.01)
*E02F 3/85* (2006.01)

(52) U.S. Cl.
USPC ..... 701/50; 701/1; 701/36; 701/49; 172/1; 172/2; 172/25; 172/75; 172/83; 172/810; 172/812; 37/234; 37/235; 37/236; 37/902

(58) Field of Classification Search
USPC ..... 701/1, 36, 49, 50; 172/1, 2, 25, 75, 83, 172/810, 812; 37/234–236, 902
See application file for complete search history.

(56) References Cited

U.S. PATENT DOCUMENTS 4,942,737 A * 7/1990 Tatsumi ..... 60/431
6,199,307 B1 * 3/2001 Kagoshima et al. ..... 37/443
6,276,134 B1 * 8/2001 Matsuyama et al. ..... 60/425
6,666,022 B1 * 12/2003 Yoshimatsu et al. ..... 60/413
7,067,999 B2 * 6/2006 Sugano et al. ..... 318/372
7,615,960 B2 * 11/2009 Morinaga et al. ..... 318/609
7,772,792 B2 * 8/2010 Kawaguchi et al. ..... 318/461
7,973,499 B2 * 7/2011 Yoshioka ..... 318/139
8,000,862 B2 * 8/2011 Morinaga et al. ..... 701/50
8,136,271 B2 * 3/2012 Sakai et al. ..... 37/348
2005/0060993 A1 * 3/2005 Oka et al. ..... 60/325
2005/0253542 A1 * 11/2005 Sugano et al. ..... 318/371

(Continued)

FOREIGN PATENT DOCUMENTS

EP 1813729 1/2007
GB 2431738 2/2007

(Continued)

OTHER PUBLICATIONS

Office Action issued Nov. 16, 2010, in Japan Patent Application No. 2006-268499 (with English-language Translation).

(Continued)

*Primary Examiner* — Jack W Keith
*Assistant Examiner* — Chuong P Nguyen
(74) *Attorney, Agent, or Firm* — Oblon, Spivak, McClelland, Maier & Neustadt, L.L.P.

(57) ABSTRACT

In a rotation control device for rotating a rotation motor at speed in accordance with a boom raising operation amount, at the time of a combined operation for simultaneously performing a rotation action and a boom raising action, a limitation value of rotation torque in accordance with the boom raising operation amount is determined by rotation torque limitation value setting means of a controller, the limitation value serving as a rotation torque limitation value is sent to rotation speed control means, and a command value of the rotation torque is torque-limited by rotation torque limiting means.

8 Claims, 7 Drawing Sheets

(56) References Cited

U.S. PATENT DOCUMENTS

| | | | | |
|---|---|---|---|---|
| 2008/0018271 | A1* | 1/2008 | Morinaga et al. | 318/257 |
| 2008/0164832 | A1* | 7/2008 | Kawaguchi et al. | 318/456 |
| 2008/0250782 | A1* | 10/2008 | Takeshita | 60/420 |
| 2009/0055056 | A1* | 2/2009 | Ooki et al. | 701/50 |
| 2012/0309577 | A1* | 12/2012 | Komaru et al. | 475/149 |

FOREIGN PATENT DOCUMENTS

| | | | |
|---|---|---|---|
| JP | 2003-328398 | | 11/2003 |
| JP | 2003-333876 | | 11/2003 |
| JP | 2004-137702 | | 5/2004 |
| WO | WO 2006/004080 | A1 | 1/2006 |
| WO | WO-2006/054581 | A1 * | 5/2006 |
| WO | WO 2006/054581 | A1 | 5/2006 |
| WO | WO 2006/054582 | A1 | 5/2006 |

OTHER PUBLICATIONS

Notice of Reasons for Rejection mailed on Jan. 5, 2011, in Japanese Patent Application No. 2006-268499 (with English Translation).

* cited by examiner

ROTATION CONTROL DEVICE FOR WORKING MACHINE

BACKGROUND OF THE INVENTION

1. Field of the Invention

The present invention relates to a hydraulic/electric combination type rotation control device for a working machine of simultaneously using a hydraulic action by a hydraulic actuator and a rotation action by an electric motor.

2. Description of the Related Art

THE RELATED ART will be described taking an excavator as an example.

The excavator is, as shown in FIGS. 7 and 8, is configured such that an upper rotating body 2 is rotatably mounted on a crawler type lower traveling body 1 around a vertical axis O. On the upper rotating body 2, is installed an excavating attachment A provided with a boom 3, an arm 4, a bucket 5, a boom cylinder 6, an arm cylinder 7, and a bucket cylinder 8.

Instead of a total hydraulic drive method in which all the actions are performed by a hydraulic actuator driven by a hydraulic pump in the excavator, as proposed in WO2006/004080A1 (hereinafter, referred to as Patent Document 1), there is a hydraulic/electric combination method in which a rotation action is performed by an electric motor (rotation motor) and other actions are performed by the hydraulic actuator driven by the hydraulic pump as in the past. Hereinafter, as necessary, an excavator using the total hydraulic drive method is called as a total hydraulic excavator, and an excavator using the combination method is called as a combination excavator.

In the combination excavator, since the rotation action is independently performed by the electric motor and not influenced by a hydraulic action, movement which is different from the total hydraulic excavator is generated at the time of a combined operation for simultaneously performing the rotation action and the hydraulic operation.

As a representative example, at the time of a combined operation of rotating and boom raising for raising the boom 3 while rotating, in the total hydraulic excavator, since a oil supply amount to a rotation motor (hydraulic motor) is decreased by raising the boom, rotation speed is reduced and a degree of speed reduction is changed in accordance with a boom raising operation amount.

Therefore, there is a problem that an operator who is accustomed to such movement of the total hydraulic excavator feels uncomfortable with the movement of the combination excavator in which the rotation speed is not changed at the time of the combined operation, and operability is bad at this point.

It should be noted that in Patent Document 1, in order to deal with the problem of uncomfortableness due to the fact that the rotation speed is not changed relative to a change of a rotation rate of an engine, the rotation speed is changed in accordance with the rotation rate of the engine so as to perform control for imitating the movement of the total hydraulic excavator.

Therefore, by applying the technique, it is possible to control the rotation motor so that the rotation speed is reduced in accordance with for example the boom raising operation amount at the time of the combined operation of rotating and boom raising.

However, as a rotation property of the total hydraulic excavator at the time of the combined operation, pressure is lowered at the same time as a decrease in an oil amount supplied from the pump to the rotation motor so that acceleration is slowed down and the speed is reduced. Therefore, even if feedback speed control for eliminating deviation between target speed and actual speed is performed, the speed would only reach a target value at the end but it is not possible to obtain a move or sense of the "slow down of acceleration".

Particularly, at the time of the combined operation of rotating and boom raising, a change in the oil supply amount to the boom cylinder is large and hence the slow down of acceleration is radical in the total hydraulic excavator. Therefore, the hydraulic rotation property is not sufficiently achieved by simple speed control and the uncomfortableness remains in the operation.

SUMMARY OF THE INVENTION

It is an object of the present invention to provide a rotation control device for working machine which is capable of making a rotation property at the time of a combined operation closer to a rotation property of a total hydraulic excavator so as to improve operability.

Firstly, the rotation control device for working machine according to the present invention has the following basic configuration.

The rotation control device for working machine according to the present invention comprises a rotation motor for rotating and driving the rotation body, a hydraulic actuator driven by pressure oil from a hydraulic pump, rotation operation means for sending a rotation signal to the rotation motor, hydraulic actuator operation means for sending an action signal to the hydraulic actuator, rotation operation amount detecting means for detecting a rotation operation amount which is an operation amount of the rotation operation means, hydraulic actuator operation amount detecting means for detecting a hydraulic actuator operation amount which is an operation amount of the hydraulic actuator operation means, and control means for controlling the rotation motor on the basis of the signals from both the operation amount detecting means, the control means being adapted:

(A) to control the rotation motor at speed in accordance with the rotation operation amount, and (B) to torque-control the rotation motor in the direction of slowing down acceleration of the rotation in accordance with an increase in the hydraulic actuator operation amount at the time of a combined operation for simultaneously performing a rotation action and a hydraulic action by the hydraulic actuator.

According to the present invention, the rotation motor is torque-controlled in the direction of slowing down the acceleration of the rotation in accordance with the increase in the hydraulic actuator operation amount at the time of the combined operation for simultaneously performing the rotation action and the hydraulic operation (particularly boom raising action). Therefore, it is possible to achieve a move or sense which is extremely close to movement of the total hydraulic excavator in which while the acceleration is slowed down, the speed is reduced. Consequently, there is no uncomfortableness in comparison to the total hydraulic excavator, and it is possible to improve the operability at this point.

In the present invention, it is preferable that in the above basic configuration, the control means torque-controls the rotation motor in the direction of reducing rotation torque in accordance with the increase in the hydraulic actuator operation amount at the time of the combined operation. Here, the "direction of reducing rotation torque" corresponds to the direction of slowing down the acceleration of the rotation in accordance with the increase in the hydraulic actuator operation amount in the above basic configuration.

In this case, in the control in the direction of reducing the rotation torque, a speed target value in accordance with the rotation operation amount is determined. At a stage where a torque command is sent to the rotation motor for speed control for achieving the speed target value, a process for limiting the torque command value is performed. Here, the "direction of reducing rotation acceleration" corresponds to the direction of slowing down the acceleration of the rotation in accordance with the increase in the hydraulic actuator operation amount in the above basic configuration.

In the present invention, it is preferable that in the above basic configuration, the control means torque-controls the rotation motor in the direction of reducing the rotation acceleration in accordance with the hydraulic actuator operation amount at the time of the combined operation.

In this case, in the control in the direction of reducing the rotation acceleration, a speed target value in accordance with the rotation operation amount is determined. At a stage where a speed command value is determined for speed control for achieving the speed target value, a process for limiting the acceleration is performed. However, a final acceleration pattern is the same as described later, and it is possible to obtain a result of the speed reduction with the slow down of the acceleration.

DESCRIPTION OF THE PREFERRED EMBODIMENTS

A description will be given to embodiments of the present invention with reference to FIGS. 1 to 6.

Figure 1:
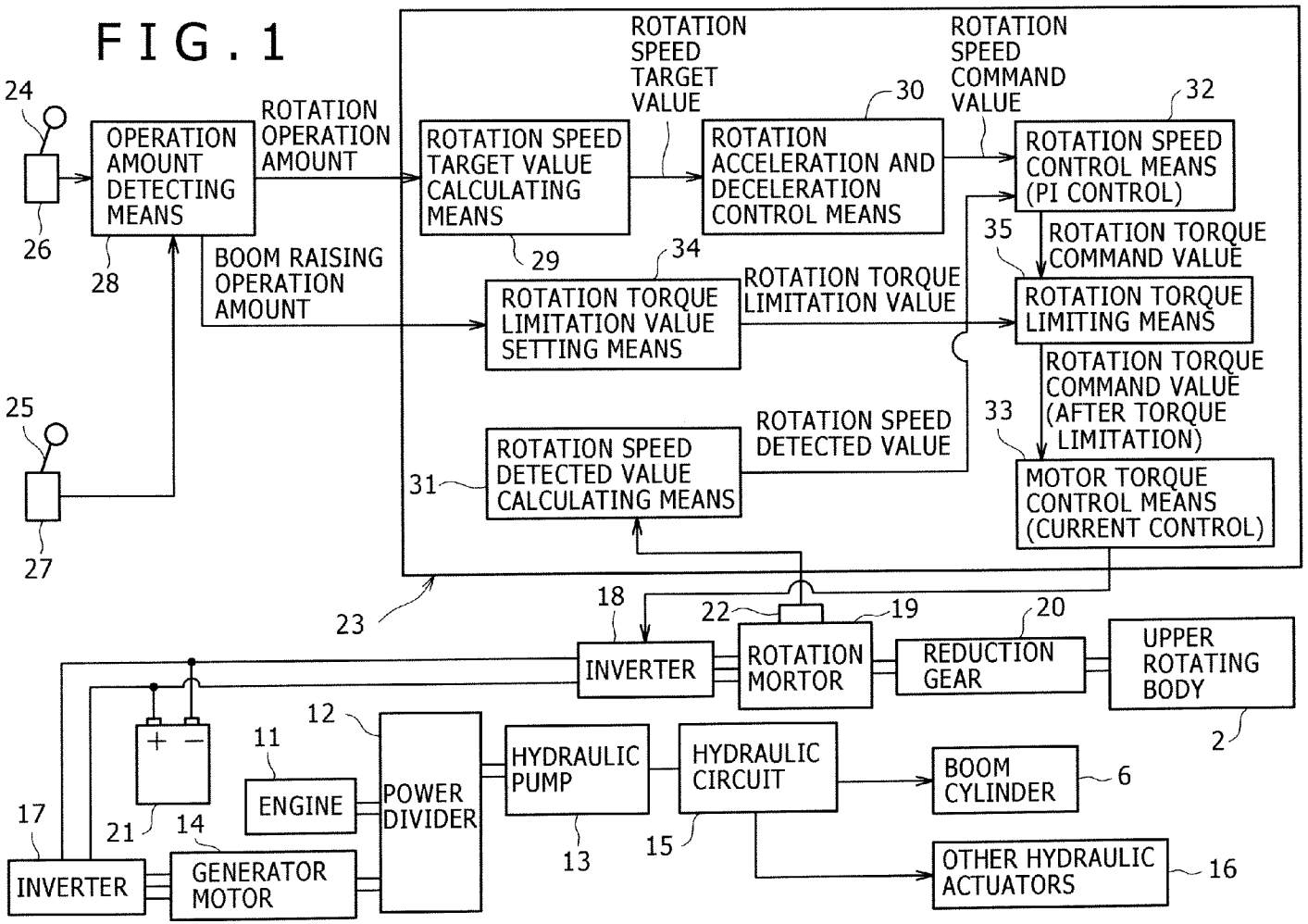
FIG. 1 is an entire block diagram of a control device according to a first embodiment of the present invention.
Figure 2:
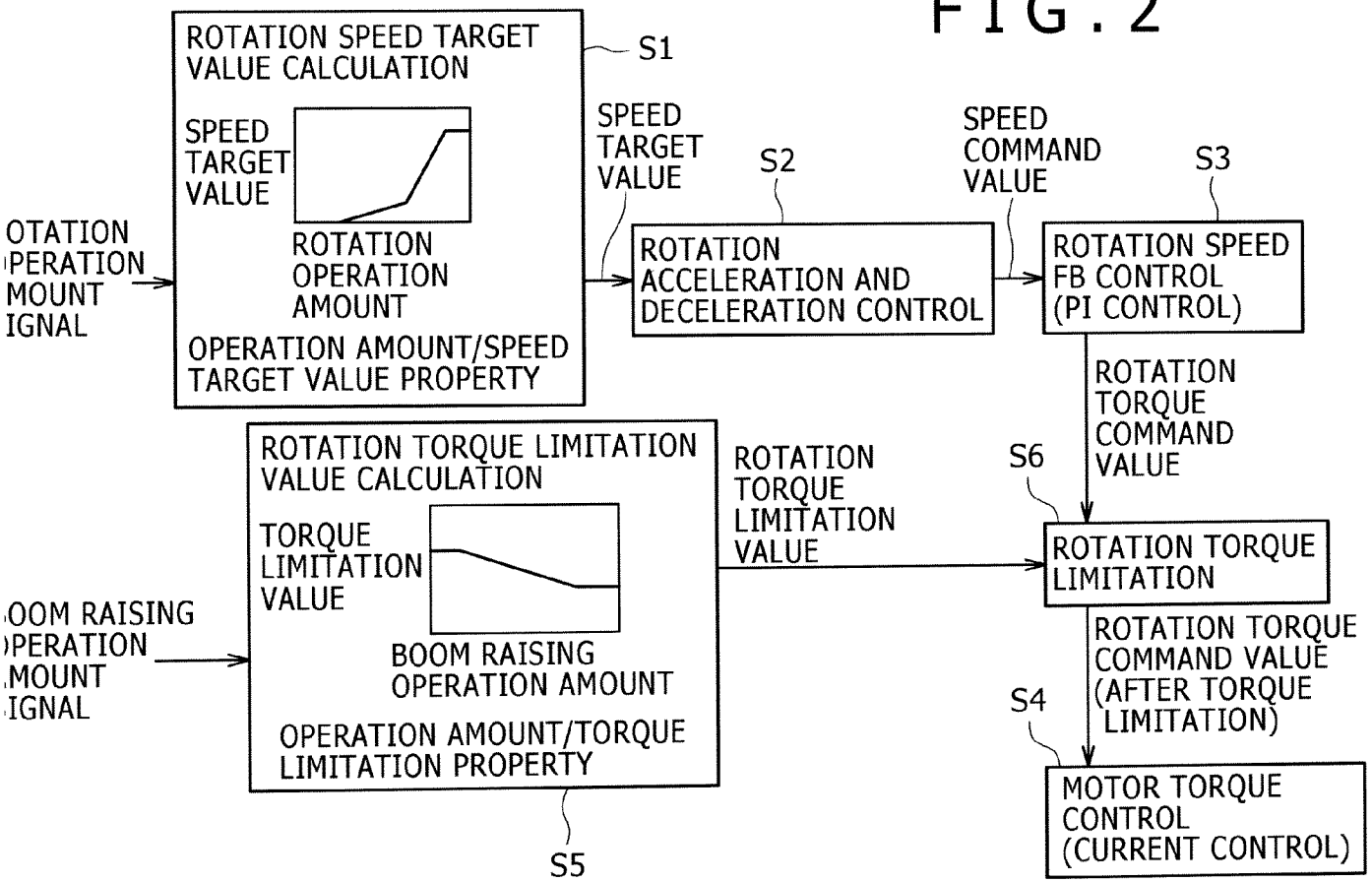
FIG. 2 is a control block diagram for explaining a control content according to the first embodiment.
Figure 3:
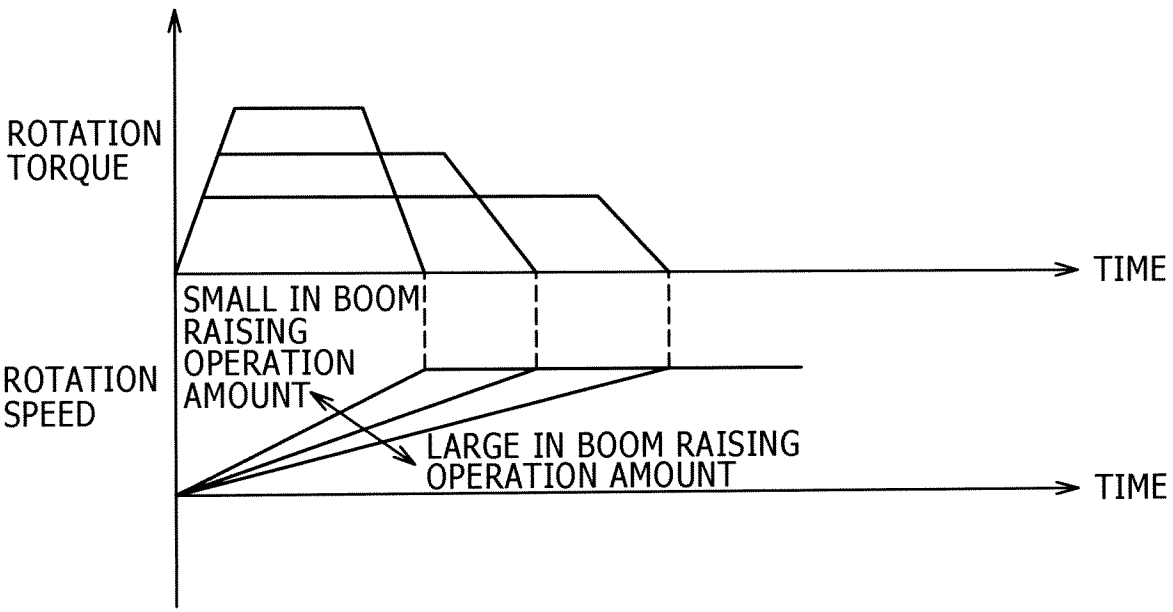
FIG. 3 is a diagram showing changing situations relative to time of rotation torque and rotation speed as a control result according to the first embodiment.
Figure 4:
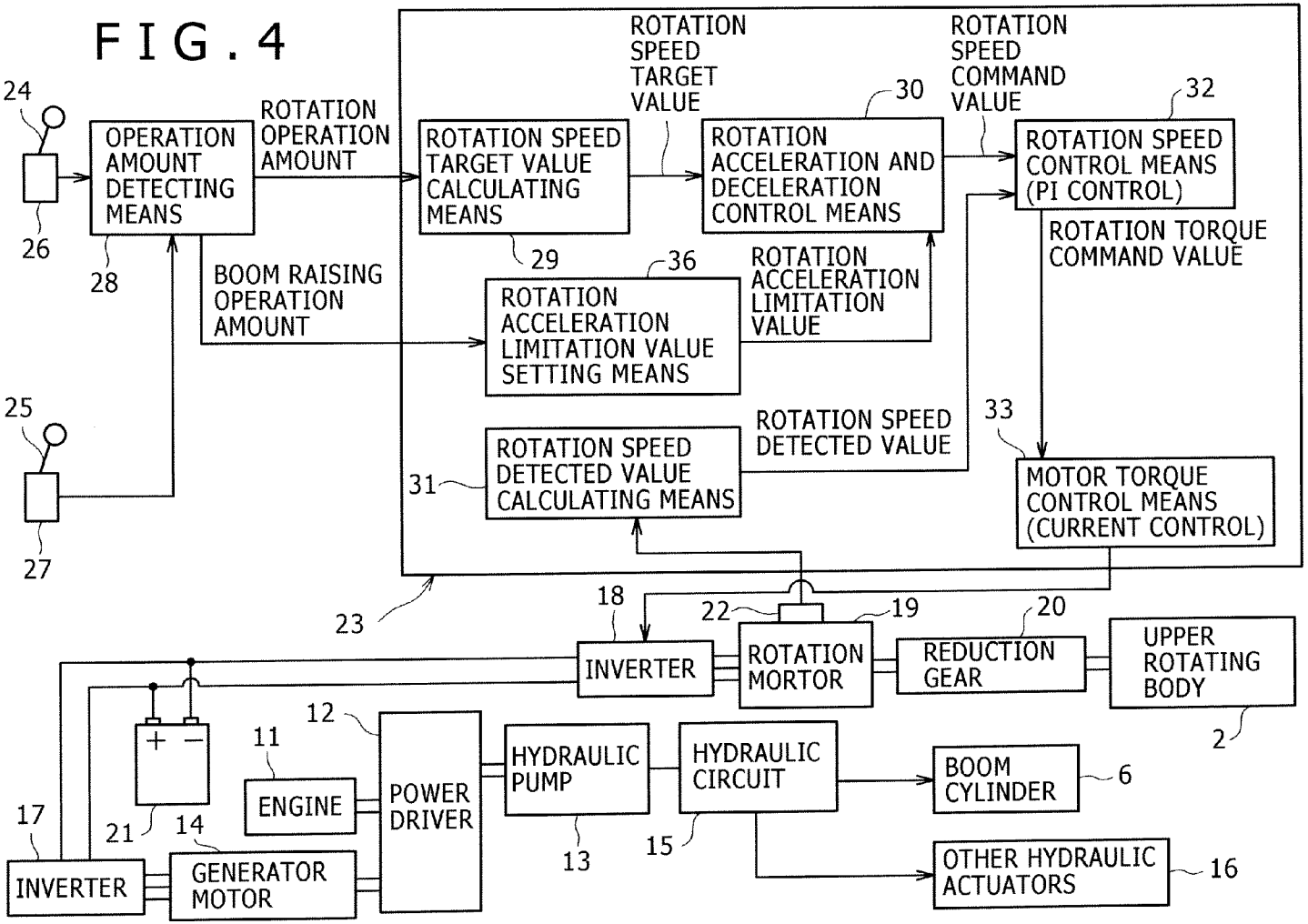
FIG. 4 is an entire block diagram of a control device according to a second embodiment.
Figure 5:
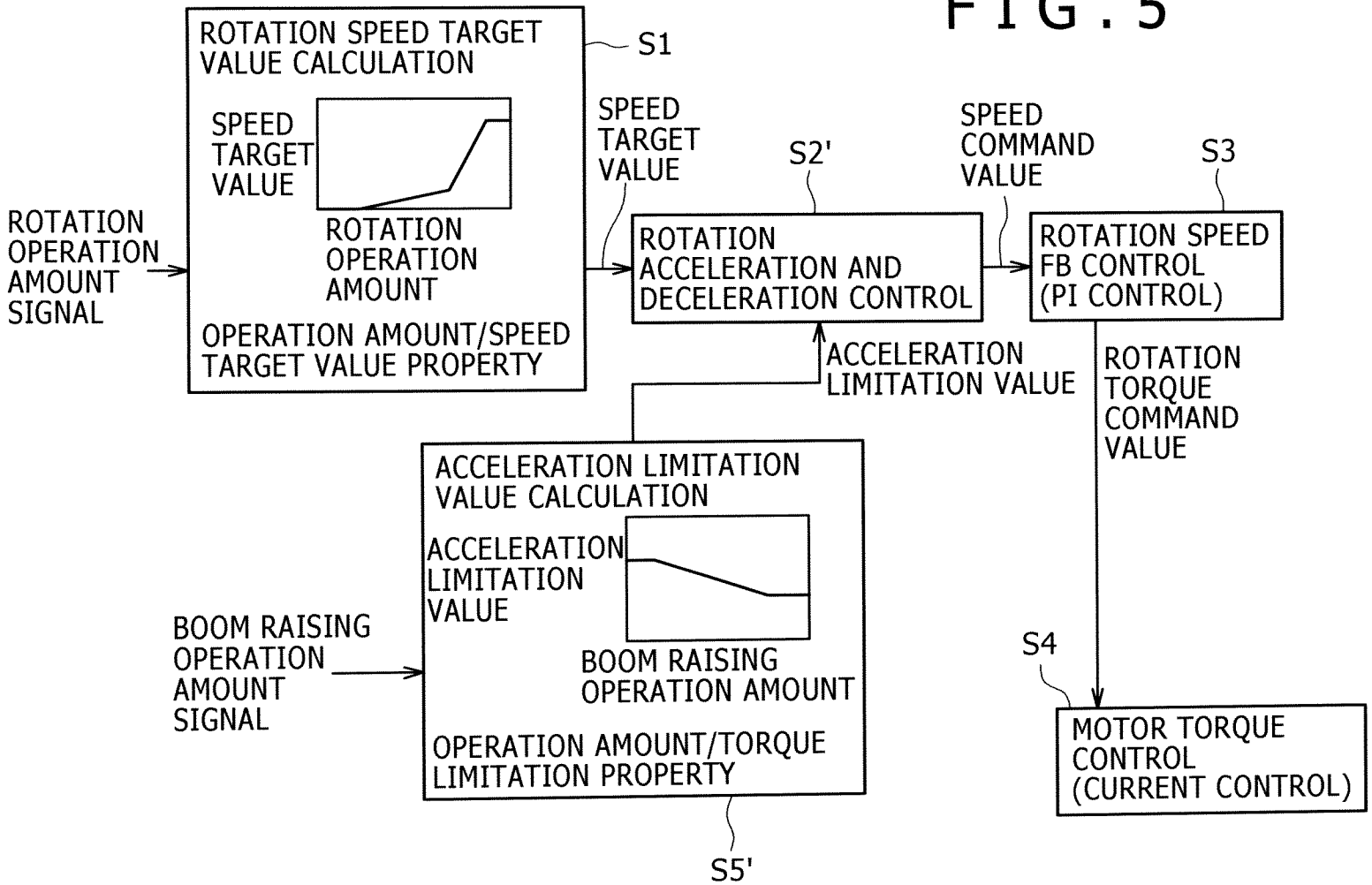
FIG. 5 is a control block diagram for explaining a control content according to the second embodiment.
Figure 6:
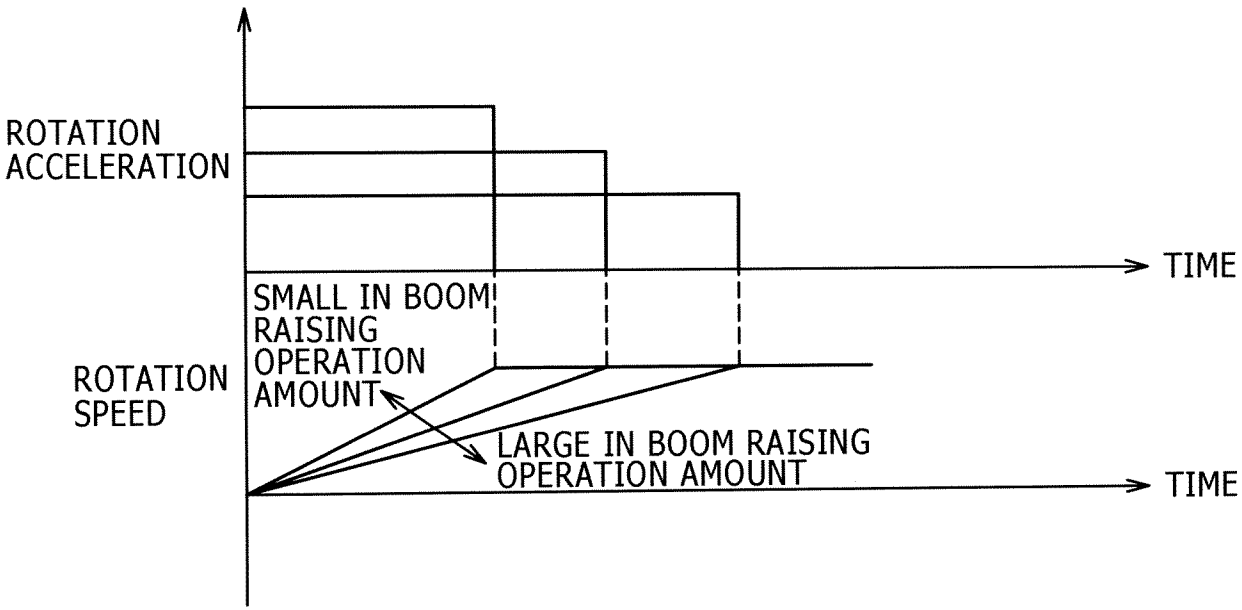
FIG. 6 is a diagram showing changing situations relative to time of rotation acceleration and rotation speed as a control result according to the second embodiment.

In a first embodiment shown in FIGS. 1 to 3, "control in the direction of reducing rotation torque" is performed in correspondence with claim 2, and in a second embodiment shown in FIGS. 4 to 6, "control in the direction of reducing rotation acceleration" is performed in correspondence with claim 3.

First Embodiment

FIG. 1 shows an entire configuration of a rotation control device according to the first embodiment.

Firstly, when drive system is explained, power of an engine 11 is added to a hydraulic pump 13 and a generator motor 14 through a power divider 12.

Figure 7:
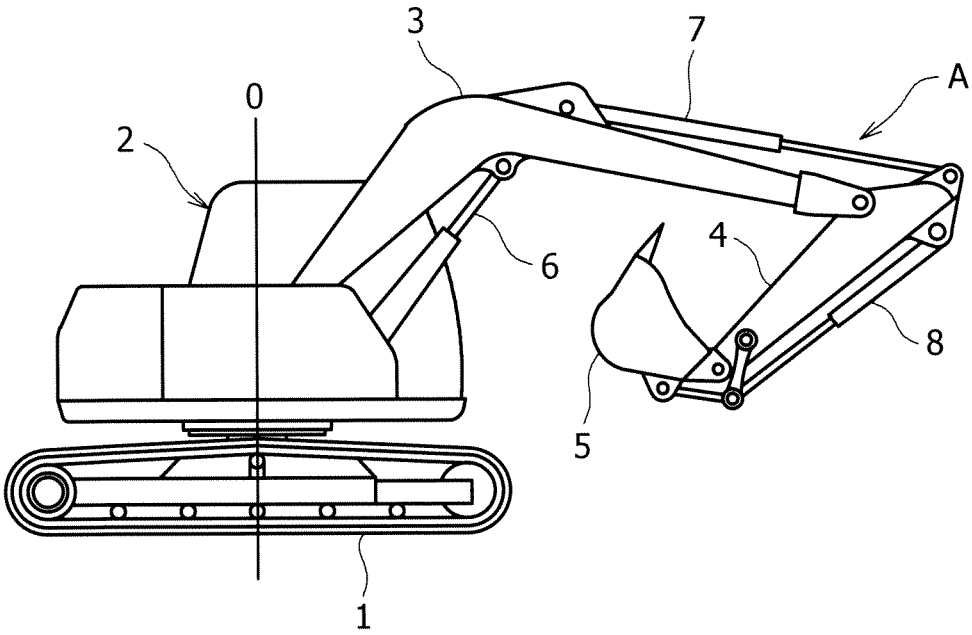
FIG. 7 is a schematic side view of an excavator.

A hydraulic circuit 15 is connected to the hydraulic pump 13, and a boom cylinder 6 shown in FIG. 7 and other hydraulic actuators (given the reference numeral 16 in total) are driven by pressure oil from the hydraulic pump 13.

Power from the generator motor 14 is sent to a rotation motor 19 through both a generator motor inverter 17 and a rotation motor inverter 18. Torque of the rotation motor 19 is transmitted to an upper rotating body 2 through a reduction gear 20, and the upper rotating body 2 is rotated around a vertical axis O shown in FIGS. 7 and 8.

A battery 21 is provided between both the inverters 17 and 18. The battery 21 is combined with the generator motor 14 and used as a power source for the rotation motor 19.

The reference numeral 22 denotes an encoder serving as rotation speed detecting means for detecting rotation speed of the rotation motor 19. The rotation speed detected by the encoder 22 is inputted to a controller 23 serving as control means.

The reference numeral 24 denotes a rotation lever serving as rotation operation means (one rotation lever is shown as used for rotation of both left and right), and the reference numeral 25 denotes a boom raising lever serving as boom raising operation means. Operation amounts of both the levers 24 and 25 (a rotation operation amount and a boom raising operation amount) are detected by operation amount detecting means 28 serving both as rotation operation amount detecting means and boom raising operation amount detecting means through signal converters 26 and 27 such as a potentiometer, and inputted to the controller 23.

It should be noted that a remote controller valve may be used as the boom raising operation means so that an operation amount thereof is converted into an electric signal by a pilot pressure sensor and sent to the operation amount detecting means 28.

The controller 23 is, as basic constituent elements, provided with rotation speed target value calculating means 29 for calculating a target value of the rotation speed from the rotation operation amount, rotation acceleration and deceleration control means 30 for outputting a command value of the rotation speed on the basis of the rotation speed target value, rotation speed detected value calculating means 31 for determining the rotation speed from a rotation speed signal sent from the encoder 22, rotation speed control means 32 for performing rotation speed feedback control (PI control), and motor torque control means 33.

A basic speed control effect according to the basic constituent elements will be described with reference to FIG. 2.

(i) In the rotation speed target value calculating means 29, the target value of the rotation speed is determined from the rotation operation amount signal (Control Step S1 in FIG. 2).

(ii) In the rotation acceleration and deceleration control means 30, the command value of the rotation speed for the rotation acceleration and deceleration control in accordance with the rotation speed target value is determined, and the rotation speed command value is sent to the rotation speed control means 32 (Control Step S2 in FIG. 2).

(iii) In the rotation speed control means 32, the rotation torque which is necessary for achieving command speed is determined, and the rotation torque serving as a rotation torque command value is outputted to the motor torque control means 33 (Control Step S3 in FIG. 2).

(iv) In the motor torque control means 33, a current value in accordance with the rotation torque command value is determined and outputted to the inverter 18 (Control Step S4 in FIG. 2).

Figure 8:
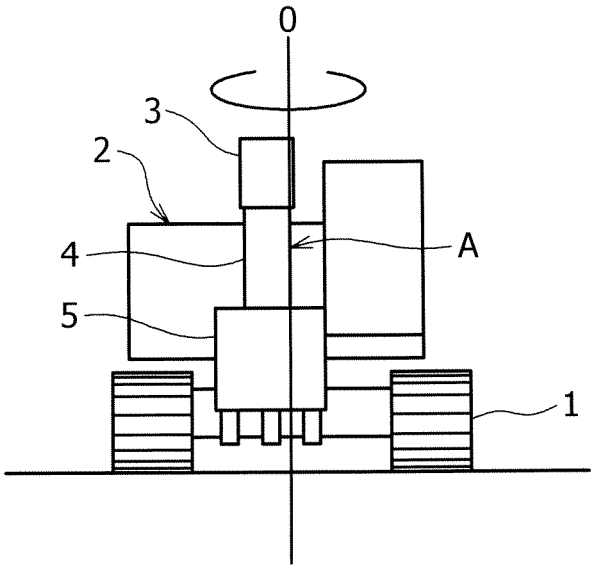
FIG. 8 is a schematic front view of the excavator.

By this, the rotation motor 19 is rotated at speed in accordance with the rotation operation amount so that the upper rotating body 2 shown in FIGS. 7 and 8 is rotated.

Here, when applying the technique disclosed in Patent Document 1, as the control of making the rotation movement closer to the rotation movement of the total hydraulic excavator at the time of the combined operation of rotating and boom raising, the speed command value in Control Step S2 is reduced in accordance with the boom raising operation amount, and speed feedback control is performed on the basis of the reduced speed command.

Meanwhile in the first embodiment, as constituent elements of making the rotation movement closer to hydraulic rotation at the time of the combined operation of rotating and boom raising, are provided rotation torque limitation value setting means 34 and rotation torque limiting means 35.

In the rotation torque limitation value setting means 34, on the basis of the boom raising operation amount from the operation amount detecting means 28, as Control Step S5 in FIG. 2, a limitation value of the rotation torque is determined from a property of boom raising operation amount/torque limitation value which is preset, and sent to the rotation torque limiting means 35.

In the rotation torque limiting means 35, as Control Step S6, the rotation torque command value from the rotation speed control means 32 is limited on the basis of the rotation torque limitation value, and the limited value serving as a final rotation torque command value is sent to the motor torque control means 33.

As a result, at the time of the combined operation of rotating and boom raising, the rotation torque is limited and the acceleration is slowed down as shown in FIG. 3. The more the boom raising operation amount is, the tighter the torque limitation (slow down of acceleration) becomes.

Therefore, it is possible to obtain the rotation property which is extremely close to the hydraulic rotation in which while the acceleration is slowed down, the speed is reduced in accordance with the boom raising operation amount.

Second Embodiment

In the second embodiment shown in FIGS. 4 to 6, the same parts as in the first embodiment are given the same reference numerals and repeated explanation thereof is omitted.

When different points from the first embodiments are explained, as understood from comparison between FIGS. 1 and 4, rotation acceleration limitation value setting means 36 is provided instead of the rotation torque limitation value setting means 34 of the first embodiment.

The rotation acceleration limitation value setting means 36 is adapted to determine an acceleration limitation value from a property of boom raising operation amount/torque limitation value which is preset on the basis of the boom raising operation amount, and send the acceleration value to the rotation acceleration and deceleration control means 30, as Control Step S5' in FIG. 5 instead of Control Step S5 in FIG. 2.

In the rotation acceleration and deceleration control means 30 receiving the acceleration limitation value, as Control Step S2', the rotation speed command value is determined by adding acceleration limitation to the rotation speed target value from the rotation speed target value calculating means 29, and sent to the rotation speed control means 32.

As a result, the rotation acceleration is slowed down in accordance with the boom raising operation amount as shown in FIG. 6, and it is possible to obtain the rotation property which is extremely close to the hydraulic rotation in which while the acceleration is slowed down, the rotation speed is reduced as well as the first embodiment.

Other Embodiments (1) In both the above embodiments, the boom raising action is taken as a representative example for a hydraulic action in which the rotation speed is reduced at the time of combined operation. However, it is possible to apply the present invention to combination with other hydraulic actions generating similar phenomenon.

(2) In both the above embodiments, it is shown that the present invention is applied to a so-called hybrid excavator in which the rotation motor 19 is driven by the generator motor 14 and the battery 21 and the hydraulic pump 13 is driven by the engine 11. However, it is possible to apply the present invention to an excavator in which a rotation motor and a motor for pump are driven by an external power source or a battery and a hydraulic pump is driven by the motor for pump.

(3) The present invention is not limited to the excavator but widely applied to a working machine of an electrically rotated type such as a crusher, a demolition machine and a groove excavator which are configured so as to take the excavator as a base.

Although the invention has been described with reference to the preferred embodiments in the attached figures, it is noted that equivalents may be employed and substitutions made herein without departing from the scope of the invention as recited in the claims.

We claim:

1. A rotation control device for a working machine, comprising:

a rotation body;

an electric motor for rotating and driving said rotation body;

a hydraulic actuator driven by pressure oil from a hydraulic pump;

rotation operation means for sending a rotation signal to said electric motor;

hydraulic actuator operation means for sending an action signal to said hydraulic actuator;

rotation operation amount detecting means for detecting a rotation operation amount which is an operation amount of said rotation operation means;

hydraulic actuator operation amount detecting means for detecting a hydraulic actuator operation amount which is an operation amount of said hydraulic actuator operation means; and a controller which controls said electric motor on the basis of the signals from both said operation amount detecting means, the controller including:

speed control means for controlling said electric motor speed in accordance with the rotation operation amount at the time of an only rotation operation, and torque control means for torque controlling said electric motor, so that a driving time of the electric motor until a rotating speed increases to a target value of the rotating speed defined by the rotation operation amount is increased in accordance with an increase in the hydraulic actuator operation amount at the time of a combined operation for simultaneously performing a rotation-acceleration action and a hydraulic action by said hydraulic actuator, and so that the driving time of the electric motor at the time of the combined operation becomes longer than that of the electric motor at the time of the only rotation operation.

2. The rotation control device for a working machine according to claim 1, wherein said torque control means torque-controls said electric motor in the direction of reducing rotation torque in accordance with the increase in the hydraulic actuator operation amount at the time of the combined operation.

3. The rotation control device for a working machine according to claim 1, wherein said torque control means torque-controls said electric motor in the direction of reducing the rotation acceleration in accordance with the hydraulic actuator operation amount at the time of the combined operation.

4. The rotation control device for a working machine according to claim 1, wherein a boom cylinder for raising and lowering a boom is provided as said hydraulic actuator, boom raising operation means for sending a command for raising the boom is provided as said hydraulic actuator operation means, boom raising operation amount detecting means for detecting an operation amount of said boom raising operation means is provided as said hydraulic actuator operation amount detecting means, and said torque control means torque-controls said electric motor in the direction of slowing down the acceleration of the rotation in accordance with an increase in the boom raising operation amount.

5. A rotation control device for a working machine, comprising:

a rotation body;

an electric motor for rotating and driving said rotation body;

a hydraulic actuator driven by pressure oil from a hydraulic pump;

rotation operation means for sending a rotation signal to said electric motor;

hydraulic actuator operation means for sending an action signal to said hydraulic actuator;

rotation operation amount detecting means for detecting a rotation operation amount which is an operation amount of said rotation operation means;

hydraulic actuator operation amount detecting means for detecting a hydraulic actuator operation amount which is an operation amount of said hydraulic actuator operation means; and a controller which controls said electric motor on the basis of the signals from both said operation amount detecting means, the controller being arranged and configured for:

controlling said electric motor speed in accordance with the rotation operation amount at the time of an only rotation operation, and torque controlling said electric motor, so that a driving time of the electric motor until a rotating speed increases to a target value of the rotating speed defined by the rotation operation amount is increased in accordance with an increase in the hydraulic actuator operation amount at the time of a combined operation for simultaneously performing a rotation-acceleration action and a hydraulic action by said hydraulic actuator, and so that the driving time of the electric motor at the time of the combined operation becomes longer than that of the electric motor at the time of the only rotation operation.

6. The rotation control device for a working machine according to claim 5, wherein said controller is arranged and configured for torque-controlling said electric motor in the direction of reducing rotation torque in accordance with the increase in the hydraulic actuator operation amount at the time of the combined operation.

7. The rotation control device for a working machine according to claim 5, wherein said controller is arranged and configured for torque-controlling said electric motor in the direction of reducing the rotation acceleration in accordance with the hydraulic actuator operation amount at the time of the combined operation.

8. The rotation control device for a working machine according to claim 5, wherein a boom cylinder for raising and lowering a boom is provided as said hydraulic actuator, boom raising operation means for sending a command for raising the boom is provided as said hydraulic actuator operation means, boom raising operation amount detecting means for detecting an operation amount of said boom raising operation means is provided as said hydraulic actuator operation amount detecting means, and said controller is arranged and configured for torque-controlling said electric motor in the direction of slowing down the acceleration of the rotation in accordance with an increase in the boom raising operation amount.

* * * * *